US009296557B2

(12) United States Patent
Petersen et al.

(10) Patent No.: US 9,296,557 B2
(45) Date of Patent: Mar. 29, 2016

(54) BULK CONTAINER WITH CENTER SUPPORT BETWEEN DROP DOOR AND SIDE WALL

(71) Applicant: Orbis Corporation, Oconomowoc, WI (US)

(72) Inventors: Robert Petersen, Park Ridge, IL (US); Scott Krebs, Hartland, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 14/577,612

(22) Filed: Dec. 19, 2014

(65) Prior Publication Data

US 2015/0175351 A1 Jun. 25, 2015

Related U.S. Application Data

(63) Continuation of application No. 14/039,767, filed on Sep. 27, 2013, now Pat. No. 8,915,397.

(60) Provisional application No. 61/721,240, filed on Nov. 1, 2012.

(51) Int. Cl.

| | |
|---|---|
| ***B65D 90/00*** | (2006.01) |
| ***B65D 6/00*** | (2006.01) |
| ***B65D 90/62*** | (2006.01) |

(52) U.S. Cl.

CPC ..... *B65D 90/008* (2013.01); *B65D 11/20* (2013.01); *B65D 90/623* (2013.01)

(58) Field of Classification Search

CPC .. B65D 43/169; B65D 90/008; B65D 90/623; B65D 11/20

USPC ..... 220/4.22, 4.23, 4.28, 4.29, 6, 7, 810, 220/836, 694; 206/577, 600; 217/12 R, 43 R

See application file for complete search history.

(56) References Cited

U.S. PATENT DOCUMENTS

| | | | |
|---|---|---|---|
| 489,711 | A | 1/1893 | Mandioni |
| 1,039,452 | A | 9/1912 | Shepard |
| 1,280,629 | A | 10/1918 | Appleby |
| 1,381,013 | A | 6/1921 | Rainsford |
| 1,883,553 | A | 10/1932 | Chain |
| 2,579,655 | A | 12/1951 | Donald |

(Continued)

FOREIGN PATENT DOCUMENTS

| | | | |
|---|---|---|---|
| CA | 1319118 | A1 | 6/1993 |
| CA | 2665281 | A1 | 11/2009 |

(Continued)

OTHER PUBLICATIONS

International Search Report and Written Opinion of International Searching Authority for PCT/US08/73306 mailed Nov. 24, 2008 (7 pages).

(Continued)

*Primary Examiner* — Robert J Hicks
*Assistant Examiner* — Kareen Thomas
(74) *Attorney, Agent, or Firm* — Nixon Peabody LLP

(57) ABSTRACT

A center support structure between a drop door and a side wall of a bulk bin container is provided. The center support structure can be an extension from a lower portion of the drop door contacting the side wall, or an extension of the side wall contacting a lower portion of the drop door.

18 Claims, 4 Drawing Sheets

(56) References Cited

U.S. PATENT DOCUMENTS

| | | | |
|---|---|---|---|
| 3,246,828 | A | 4/1966 | Branscum et al. |
| 3,572,535 | A | 3/1971 | Kinzie |
| 3,628,683 | A | 12/1971 | Friedrich |
| 3,692,342 | A | 9/1972 | Scallan |
| 3,747,794 | A | 7/1973 | Bitney |
| 3,870,185 | A | 3/1975 | Sanders et al. |
| 3,874,546 | A | 4/1975 | Sanders et al. |
| 3,924,293 | A | 12/1975 | Cain |
| 3,977,044 | A | 8/1976 | Mort |
| 4,044,910 | A | 8/1977 | Box |
| 4,063,330 | A | 12/1977 | Triplette |
| 4,089,417 | A | 5/1978 | Osborne |
| 4,119,263 | A | 10/1978 | Cuthbertson et al. |
| 4,186,841 | A | 2/1980 | Buckley et al. |
| 4,192,430 | A | 3/1980 | Cornou |
| 4,300,695 | A | 11/1981 | Hsu |
| 4,349,121 | A | 9/1982 | Lafferty |
| 4,454,946 | A | 6/1984 | Yokowo |
| 4,466,541 | A | 8/1984 | Tabler et al. |
| 4,491,231 | A | 1/1985 | Heggeland et al. |
| 4,571,774 | A | 2/1986 | Hinson |
| 4,591,065 | A | 5/1986 | Foy |
| 4,674,647 | A | 6/1987 | Gyenge et al. |
| 4,765,480 | A | 8/1988 | Malmanger |
| 4,775,068 | A | 10/1988 | Reiland et al. |
| 4,798,304 | A | 1/1989 | Rader |
| 4,828,132 | A | 5/1989 | Francis, Jr. et al. |
| 4,863,062 | A | 9/1989 | Holliday |
| 4,917,255 | A | 4/1990 | Foy et al. |
| 4,923,079 | A | 5/1990 | Foy |
| 4,960,223 | A | 10/1990 | Chiang et al. |
| 4,967,927 | A | 11/1990 | Reiland et al. |
| 4,987,639 | A | 1/1991 | Baiuley et al. |
| 5,094,356 | A | 3/1992 | Miller |
| 5,114,037 | A | 5/1992 | Hillis et al. |
| 5,150,806 | A | 9/1992 | Glomski |
| 5,199,592 | A | 4/1993 | Reiland et al. |
| 5,289,935 | A | 3/1994 | Hillis et al. |
| 5,398,835 | A | 3/1995 | Blinstrub |
| 5,467,885 | A | 11/1995 | Blinstrub |
| 5,474,197 | A | 12/1995 | Hillis et al. |
| 5,501,353 | A | 3/1996 | Warren |
| 5,535,482 | A | 7/1996 | Grabber |
| 5,538,178 | A | 7/1996 | Zink et al. |
| 5,586,675 | A | 12/1996 | Borsboom et al. |
| 5,632,392 | A | 5/1997 | Oh |
| D381,513 | S | 7/1997 | Brauner |
| 5,660,291 | A | 8/1997 | Dash |
| 5,673,791 | A | 10/1997 | Jamison |
| 5,711,444 | A | 1/1998 | Meacham et al. |
| 5,725,119 | A | 3/1998 | Bradford et al. |
| 5,769,230 | A | 6/1998 | Koefelda |
| 5,788,103 | A | 8/1998 | Wagner et al. |
| 5,797,508 | A | 8/1998 | Loftus et al. |
| 5,845,799 | A | 12/1998 | Deaton |
| 5,850,935 | A | 12/1998 | Luburic et al. |
| 5,897,012 | A | 4/1999 | Sortwell |
| 5,908,135 | A | 6/1999 | Bradford et al. |
| 5,938,059 | A | 8/1999 | Luburic |
| 5,975,324 | A | 11/1999 | Schmitt |
| 6,000,604 | A | 12/1999 | Lapoint, III |
| 6,015,056 | A | 1/2000 | Overholt et al. |
| 6,029,839 | A | 2/2000 | Mansouri |
| 6,029,840 | A | 2/2000 | Brauner |
| 6,062,410 | A | 5/2000 | Bradford et al. |
| 6,088,239 | A | 7/2000 | Zeiss |
| 6,135,287 | A | 10/2000 | Hartwall |
| 6,138,851 | A | 10/2000 | Townson |
| 6,186,932 | B1 | 2/2001 | Vallot |
| 6,189,695 | B1 | 2/2001 | Ching-rong |
| 6,209,742 | B1 | 4/2001 | Overholt et al. |
| 6,216,872 | B1 | 4/2001 | Haasbroek |
| 6,216,899 | B1 | 4/2001 | Vicari |
| 6,223,903 | B1 | 5/2001 | Mansouri |
| 6,230,916 | B1 | 5/2001 | Bradford et al. |
| 6,234,315 | B1 | 5/2001 | Karpisek |
| 6,243,920 | B1 | 6/2001 | Sauve |
| 6,283,319 | B1 | 9/2001 | Hillis et al. |
| 6,290,081 | B1 | 9/2001 | Merey |
| 6,293,417 | B1 | 9/2001 | Varfeldt |
| 6,293,418 | B1 | 9/2001 | Ogden et al. |
| 6,305,566 | B1 | 10/2001 | Pigott et al. |
| 6,305,726 | B1 | 10/2001 | LeTrudet |
| D452,614 | S | 1/2002 | Overholt |
| 6,367,630 | B1 | 4/2002 | Elskamp |
| 6,386,388 | B1 | 5/2002 | Overholt |
| 6,398,054 | B1 | 6/2002 | Overholt et al. |
| 6,405,888 | B1 | 6/2002 | Overholt et al. |
| 6,415,938 | B1 | 7/2002 | Karpisek |
| 6,416,271 | B1 | 7/2002 | Pigott et al. |
| 6,422,409 | B2 | 7/2002 | Kofod |
| 6,446,825 | B1 | 9/2002 | Godoy |
| 6,460,717 | B1 | 10/2002 | Smyers et al. |
| 6,484,898 | B2 | 11/2002 | Hillis et al. |
| RE37,915 | E | 12/2002 | Lapoint, III |
| 6,540,096 | B1 | 4/2003 | Bazany et al. |
| 6,543,659 | B2 | 4/2003 | Blair |
| 6,601,724 | B1 | 8/2003 | Koefelda et al. |
| 6,631,822 | B1 | 10/2003 | Overholt |
| 6,669,044 | B2 | 12/2003 | Murakami et al. |
| 6,691,885 | B2 | 2/2004 | Brown |
| 6,726,046 | B2 | 4/2004 | Orset |
| 6,776,300 | B2 | 8/2004 | Walsh et al. |
| 6,783,032 | B2 | 8/2004 | Fons |
| 6,783,058 | B2 | 8/2004 | Quaintance |
| 6,786,394 | B2 | 9/2004 | Prince |
| 6,805,254 | B2 | 10/2004 | Tanzer et al. |
| 6,820,761 | B1 | 11/2004 | Mouri et al. |
| 6,838,616 | B2 | 1/2005 | Harrison et al. |
| 6,863,180 | B2 | 3/2005 | Apps et al. |
| 6,868,979 | B2 | 3/2005 | Rader |
| 6,877,628 | B2 | 4/2005 | Nesting |
| 6,899,242 | B2 | 5/2005 | Overholt et al. |
| 6,902,061 | B1 | 6/2005 | Elstone |
| 6,918,502 | B1 | 7/2005 | Overholt et al. |
| 6,955,273 | B2 | 10/2005 | Hartwall |
| 6,966,449 | B2 | 11/2005 | Williams |
| 7,011,225 | B2 | 3/2006 | Oster et al. |
| 7,017,765 | B2 | 3/2006 | Overholt |
| 7,017,766 | B2 | 3/2006 | Hsu et al. |
| 7,032,765 | B2 | 4/2006 | Miller et al. |
| 7,044,319 | B2 | 5/2006 | Overholt et al. |
| 7,048,135 | B2 | 5/2006 | Smyers et al. |
| 7,059,489 | B2 | 6/2006 | Apps et al. |
| 7,063,223 | B2 | 6/2006 | Iwahara et al. |
| 7,083,369 | B2 | 8/2006 | Nyeboer |
| 7,100,786 | B2 | 9/2006 | Smyers |
| 7,104,414 | B2 | 9/2006 | Apps et al. |
| 7,128,209 | B2 | 10/2006 | Bringard et al. |
| 7,128,231 | B2 | 10/2006 | Overholt |
| 7,137,522 | B2 | 11/2006 | Dubois |
| 7,156,249 | B2 | 1/2007 | Heinrichs |
| 7,159,730 | B2 | 1/2007 | Rumpel |
| 7,195,127 | B2 | 3/2007 | Hsu et al. |
| 7,258,232 | B2 | 8/2007 | Bradford et al. |
| 7,264,122 | B2 | 9/2007 | Koefelda et al. |
| 7,287,661 | B2 | 10/2007 | Knutsson et al. |
| 7,311,220 | B2 | 12/2007 | Kellerer |
| 7,331,480 | B1 | 2/2008 | Nolan |
| 7,347,328 | B2 | 3/2008 | Hartwall |
| 7,357,269 | B2 | 4/2008 | Apps |
| 7,357,271 | B2 | 4/2008 | Hase et al. |
| 7,370,771 | B2 | 5/2008 | Rader |
| 7,416,092 | B2 | 8/2008 | Dubois et al. |
| 7,438,197 | B2 | 10/2008 | Yamauchi |
| 7,478,734 | B2 | 1/2009 | Vargas |
| 7,484,634 | B2 | 2/2009 | Apps |
| 7,540,390 | B2 | 6/2009 | Bublitz et al. |
| 7,549,550 | B2 | 6/2009 | Smyers et al. |
| 7,556,165 | B2 | 7/2009 | McDade |
| 7,556,166 | B2 | 7/2009 | Parnall et al. |
| 7,708,160 | B2 | 5/2010 | Booth et al. |
| 7,748,330 | B2 | 7/2010 | Dubois et al. |
| 7,774,919 | B2 | 8/2010 | Bublitz et al. |

(56) References Cited

U.S. PATENT DOCUMENTS

| | | | |
|---|---|---|---|
| 7,828,167 | B2 | 11/2010 | Nolan |
| 7,841,487 | B2 | 11/2010 | Miller et al. |
| 7,861,458 | B2 | 1/2011 | Apps et al. |
| 7,861,879 | B2 | 1/2011 | Samprathi |
| 7,870,970 | B2 | 1/2011 | Fisk |
| 8,109,402 | B2 | 2/2012 | Hartwall |
| 8,123,062 | B2 * | 2/2012 | Tontarelli ..... B65D 11/1833 220/6 |
| 8,181,806 | B2 | 5/2012 | Hidalgo Vargas |
| 8,210,379 | B2 | 7/2012 | Afflerbach et al. |
| 8,267,270 | B2 | 9/2012 | Samprathi |
| 8,308,015 | B2 | 11/2012 | Bradford |
| 8,413,831 | B2 | 4/2013 | Nolan |
| 8,434,618 | B2 | 5/2013 | Mitchell et al. |
| 8,485,376 | B2 | 7/2013 | Samprathi |
| 8,511,496 | B2 | 8/2013 | Van Der Korput et al. |
| 8,727,158 | B2 | 5/2014 | Nolan |
| 8,727,165 | B2 | 5/2014 | Nolan |
| 8,820,558 | B2 | 9/2014 | Van Der Korput et al. |
| 8,820,560 | B2 | 9/2014 | Nolan |
| 8,915,397 | B2 | 12/2014 | Petersen et al. |
| 2002/0108950 | A1 | 8/2002 | Moorman et al. |
| 2004/0065699 | A1 | 4/2004 | Schoer et al. |
| 2005/0103797 | A1 | 5/2005 | Rader et al. |
| 2006/0011627 | A1 | 1/2006 | Overholt et al. |
| 2007/0029319 | A1 | 2/2007 | Speck |
| 2007/0056967 | A1 | 3/2007 | Dobrinski et al. |
| 2007/0056977 | A1 | 3/2007 | Dobrinski et al. |
| 2007/0068941 | A1 | 3/2007 | Dubois |
| 2007/0075077 | A1 | 4/2007 | Dubois |
| 2007/0095842 | A1 | 5/2007 | Apps |
| 2007/0140684 | A1 | 6/2007 | Tsang |
| 2007/0181587 | A1 | 8/2007 | Burnham |
| 2007/0194023 | A1 | 8/2007 | Apps et al. |
| 2007/0272579 | A1 | 11/2007 | Cavalcante |
| 2007/0278223 | A1 | 12/2007 | Ficker |
| 2008/0017638 | A1 | 1/2008 | Bradford |
| 2008/0116199 | A1 | 5/2008 | Bublitz et al. |
| 2008/0116201 | A1 | 5/2008 | Baltz |
| 2008/0169285 | A1 | 7/2008 | Marazita et al. |
| 2009/0134176 | A1 | 5/2009 | Yamauchi |
| 2009/0205169 | A1 * | 8/2009 | Nolan et al. ..... 16/321 |
| 2010/0018966 | A1 | 1/2010 | Roberts, Sr. et al. |
| 2010/0038331 | A1 | 2/2010 | Ydstrom |
| 2010/0072199 | A1 | 3/2010 | Manuel |
| 2010/0239730 | A1 | 9/2010 | Ditter |
| 2010/0275426 | A1 | 11/2010 | Bublitz et al. |
| 2011/0127275 | A1 | 6/2011 | Dubois |
| 2011/0139775 | A1 | 6/2011 | Nolan |
| 2012/0152798 | A1 | 6/2012 | Allegretti et al. |
| 2012/0205369 | A1 | 8/2012 | Nolan |
| 2012/0318692 | A1 | 12/2012 | Kellerer |
| 2013/0048522 | A1 | 2/2013 | Lorenz et al. |
| 2013/0221003 | A1 | 8/2013 | Carver et al. |
| 2014/0042175 | A1 | 2/2014 | Nolan |
| 2014/0117035 | A1 | 5/2014 | Petersen et al. |
| 2014/0252018 | A1 | 9/2014 | Nolan |

FOREIGN PATENT DOCUMENTS

| | | | |
|---|---|---|---|
| CN | 200930355382.X | | 7/2010 |
| CN | 200930355383.4 | | 7/2010 |
| CN | 2009303553834.9 | | 7/2010 |
| CN | 201020111642.6 | | 11/2010 |
| CN | 20102145498.8 | | 12/2010 |
| CN | 201020159206.6 | | 12/2010 |
| CN | 201020198781.7 | | 12/2010 |
| CN | 201020132357.2 | | 1/2011 |
| CN | 201020218082.4 | | 1/2011 |
| CN | 201020218085.8 | | 4/2011 |
| CN | 201020169698.7 | | 5/2011 |
| DE | 135488 | C | 11/1933 |
| EP | 0385914 | A1 | 5/1990 |
| EP | 0485672 | A1 | 5/1992 |
| EP | 0785142 | A1 | 7/1997 |
| EP | 0768229 | B1 | 7/1999 |
| EP | 1019293 | B1 | 5/2002 |
| EP | 0737152 | B1 | 8/2002 |
| EP | 1350728 | A2 | 10/2003 |
| EP | 1418130 | A1 | 5/2004 |
| EP | 1427641 | B1 | 6/2004 |
| EP | 1461259 | B1 | 9/2004 |
| EP | 1652646 | A2 | 5/2006 |
| EP | 1440011 | B1 | 6/2006 |
| EP | 147247 | B1 | 9/2006 |
| EP | 1927552 | A2 | 6/2007 |
| EP | 1827942 | A2 | 9/2007 |
| EP | 1935792 | A1 | 6/2008 |
| EP | 1616803 | B1 | 10/2009 |
| FR | 80400 | E | 10/1961 |
| FR | 2272907 | A1 | 12/1975 |
| GB | 2415689 | A | 1/2006 |
| GB | 2425303 | A | 10/2006 |
| GB | 2431921 | A | 5/2007 |
| GB | 2431922 | A | 5/2007 |
| GB | 2438506 | A | 11/2007 |
| GB | 2443949 | A | 5/2008 |
| GB | 2426237 | B | 12/2008 |
| JP | 03381677 | A | 12/2002 |
| KR | 1999-0061830 | | 7/1999 |
| SE | 323908 | B | 5/1970 |
| SE | 522095 | C2 | 1/2004 |
| WO | 9640564 | A1 | 12/1996 |
| WO | 0176960 | A1 | 10/2001 |
| WO | 03024815 | A1 | 3/2003 |
| WO | 03029090 | A1 | 4/2003 |
| WO | 03059763 | A1 | 7/2003 |
| WO | 03074376 | A1 | 9/2003 |
| WO | 03078259 | A1 | 9/2003 |
| WO | 03101846 | A1 | 12/2003 |
| WO | 2004033311 | A2 | 4/2004 |
| WO | 2004080830 | A1 | 9/2004 |
| WO | 2004085779 | A2 | 10/2004 |
| WO | 2004094250 | A1 | 11/2004 |
| WO | 2004101376 | A1 | 11/2004 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |
| WO | 2009023830 | A1 | 2/2009 |

OTHER PUBLICATIONS

International Search Report for PCT/US2013/067243 mailed Feb. 7, 2014 (3 pages).

International Preliminary Report on Patentability and Written Opinion of International Searching Authority for PCT/US2008/073306 mailed Feb. 16, 2010 (6 pages).

Written Opinion of International Searching Authority for PCT/US2013/067243 mailed Feb. 7, 2014 (4 pages).

* cited by examiner

BULK CONTAINER WITH CENTER SUPPORT BETWEEN DROP DOOR AND SIDE WALL

CROSS-REFERENCE TO RELATED APPLICATIONS

The present application is a continuation of U.S. patent application Ser. No. 14/039,767 filed Sep. 27, 2013, which claims the benefit of U.S. Provisional Application No. 61/721,240 filed Nov. 1, 2012, the contents of which are incorporated herein by reference.

FEDERALLY SPONSORED RESEARCH OR DEVELOPMENT

N/A

FIELD OF THE INVENTION

The present invention generally relates to a bulk bin container having a central support structure between a first hinge and a second hinge connecting a drop door to the side wall of the container.

BACKGROUND OF THE INVENTION

Large plastic bulk bin containers typically are provided with a drop door in one or more of the side walls of the container. The door typically filled a squared off U-shaped opening in the side wall. When upright, the top edge of the door formed part of the top edge of the side wall.

The drop door is connected to the side wall by two or more hinge elements along a bottom edge of the door. Such doors are used to provide access to the interior of the bulk bin. This is particularly useful when access through the top of the bulk bin is restricted, such as when other items (e.g., additional bulk bins, etc.) are stacked on the bulk bin.

In the past, a gap is formed between the drop door and the side wall in the central area between the hinge elements (see e.g., FIG. 3). Loads applied to the top of the bulk bin were transferred primarily to the hinge elements. This could cause bowing, buckling or other displacement of the drop door with respect to the side wall, and/or failure or damage to the hinge elements.

The present bulk container provides improved structure between the door and the side wall designed to overcome some or all of the deficiencies found in prior bulk bin containers.

SUMMARY OF THE INVENTION

The present invention provides a bulk bin container having a central support structure between the hinge elements connecting a drop door to a side wall.

In accordance with one embodiment of the invention, a bulk bin container having support structure between a drop door and a side wall is provided. The bulk bin container comprises a base and a first side wall extending upward from a first side of the base. The first side wall includes a generally rectangular opening. A first drop door is connected to the first side wall by a first articulated hinge and a second articulated hinge spaced from the first articulated hinge. The first drop door fills the opening and forms part of the first side wall when in an upright position. The door exposes the opening when in a collapsed position allowing access to the interior of the container. A central support structure is provided that extends downward from a lower edge of the first drop door between the first articulated hinge and the second articulated hinge. The central support structure is designed to contact an upper edge of the first side wall defining a lower limit of the opening such that loads applied to a top of the drop door are transferred to the first side wall through the central support structure.

The central support structure is designed to prevent the first drop door from moving inward. In this regard, the central support structure can include a first lower portion extending from an exterior side of the drop door and a second upper portion extending from an interior side of the drop door. The side wall can include a lip extending from the interior side of the side wall that contacts a side of the first lower portion to prevent the drop door from moving inwardly.

The central support structure can be an extension of the door that comprises a rib. Alternatively, the extension can comprise two or more ribs.

The first side wall can be hingedly connected to the base. Additionally, the container can comprise a second side wall extending upward from a second side of the base, a third side wall extending upward from a third side of the base, and a fourth side wall extending upward from a fourth side of the base. Each of the second through fourth side walls can also be hingedly connected to the base.

The container can include more than one drop door with a central support structure. In this regard, the container can include a second drop door connected to the second side wall by a first articulated hinge and a second articulated hinge spaced from the first articulated hinge. The second drop door fills the opening and forms part of the second side wall when in an upright position. The door exposes the opening when in a collapsed position. A central support structure extends downward from a lower edge of the second drop door between the first articulated hinge and the second articulated hinge. The central support contacts an upper edge of the second side wall defining a lower limit of the opening such that loads applied to a top of the drop door are transferred to the second side wall through the central support structure of the second drop door.

The central support structure can be a single piece, or it can comprise a first segment and a second segment separated from the first segment by a gap. Similarly, the central support structure can comprise a plurality of segments separated by gaps.

In an alternative embodiment, the support structure can extend upward from the side wall to contact a lower edge of the drop door. In this regard, a bulk bin container is provided that comprises a base, a first side wall extending upward from a first side of the base and including an opening, and a first drop door connected to the first side wall by a first articulated hinge and a second articulated hinge spaced from the first articulated hinge. The first drop door fills the opening and forms part of the first side wall when in an upright position and exposes the opening when in a collapsed position. A central support structure extends upward from an upper edge of the first side wall between the first articulated hinge and the second articulated hinge. The central support contacts a lower edge of the first drop door such that loads applied to a top of the first drop door are transferred to the first side wall through the central support structure.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
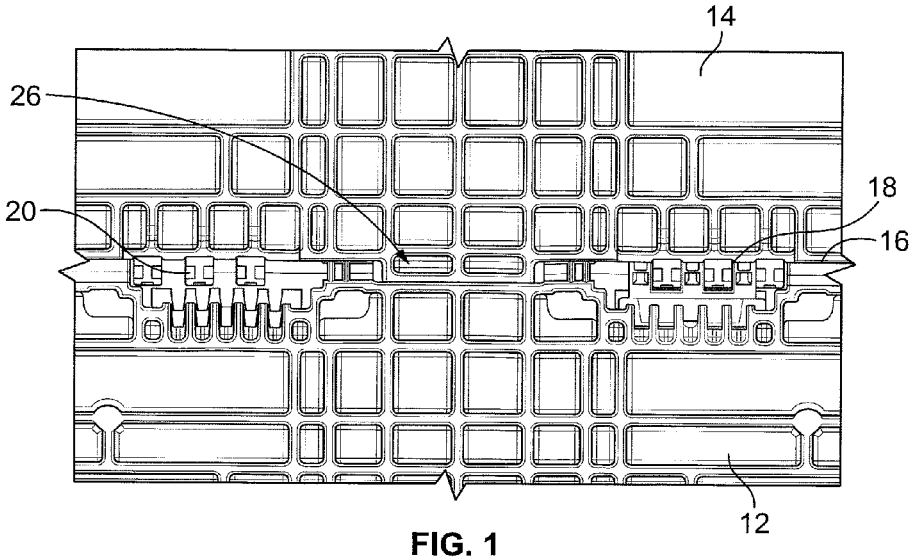
FIG. 1 is a partial view of a drop door hingedly connected to a side wall of a bulk bin container in an upright position having a central extension between the drop door and the side wall in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

Figure 2:
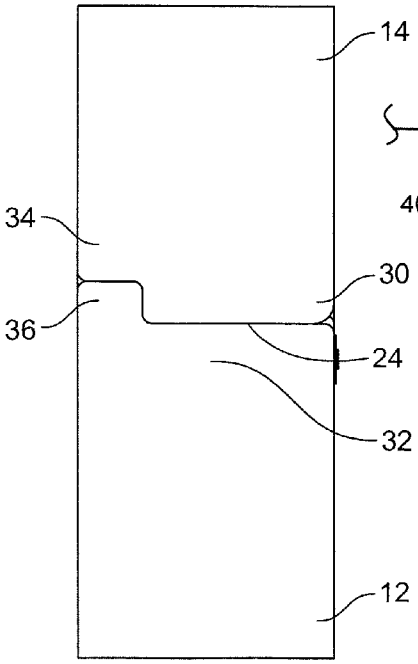
FIG. 2 is a cross-section of the drop door and the side wall of FIG. 1 showing the central extension with the drop door in an upright position.
Figure 7:
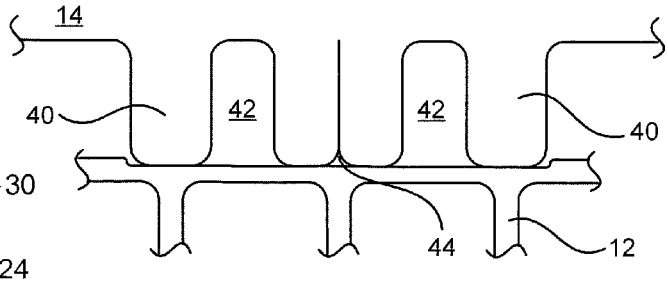
FIG. 7 is a partial view of an alternative support structure.
Figure 3:
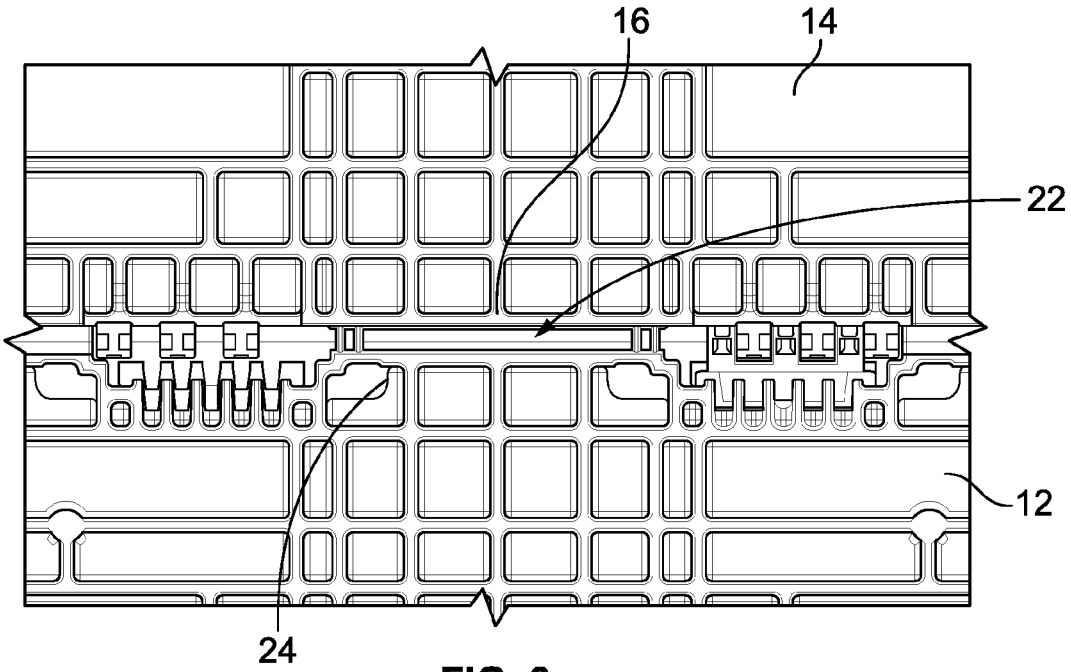
FIG. 3 is a partial view of a drop door hingedly connected to a side wall of a bulk container in an upright position without a central extension.
Figure 4:
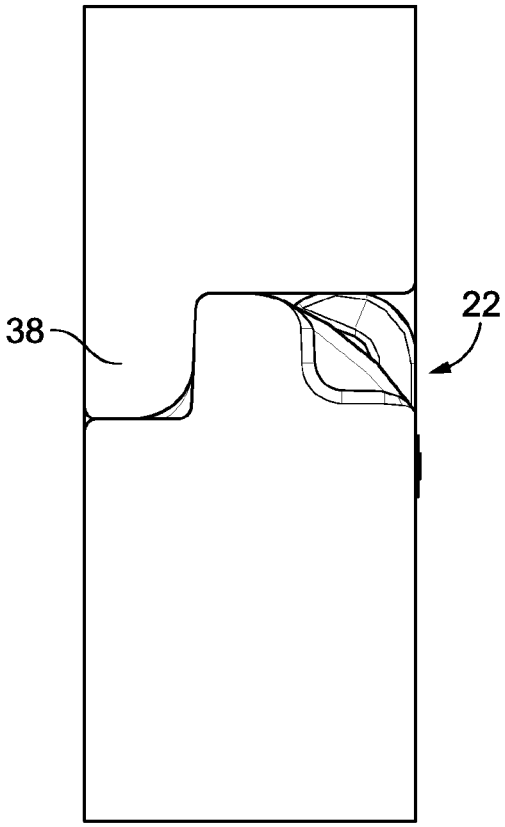
FIG. 4 is a cross-section of the drop door and side wall of FIG. 3.
Figure 6:
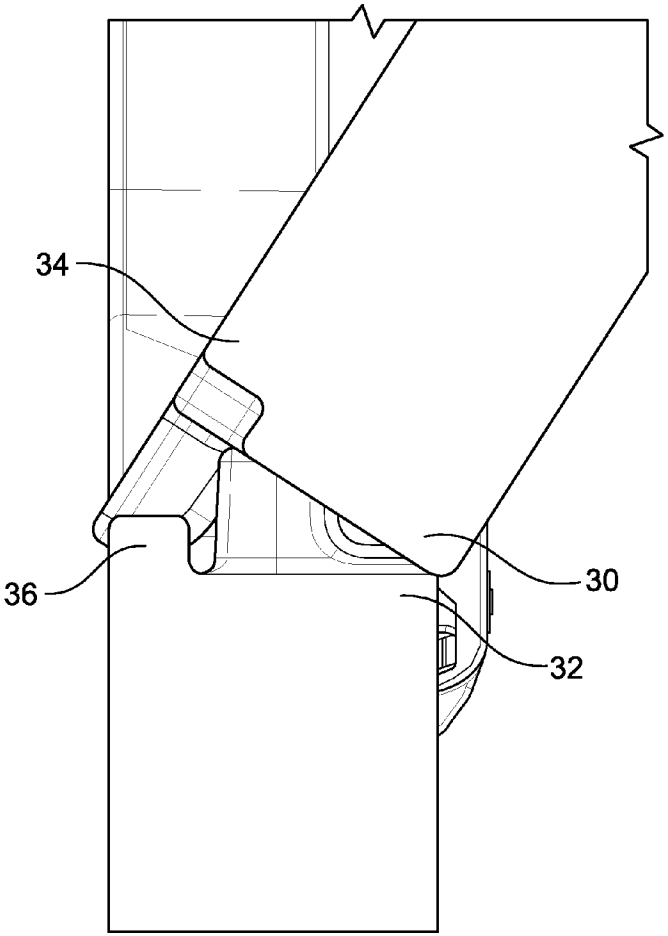
FIG. 6 is a cross-section of the drop door and side wall of FIG. 3 in a partially open position.
Figure 5:
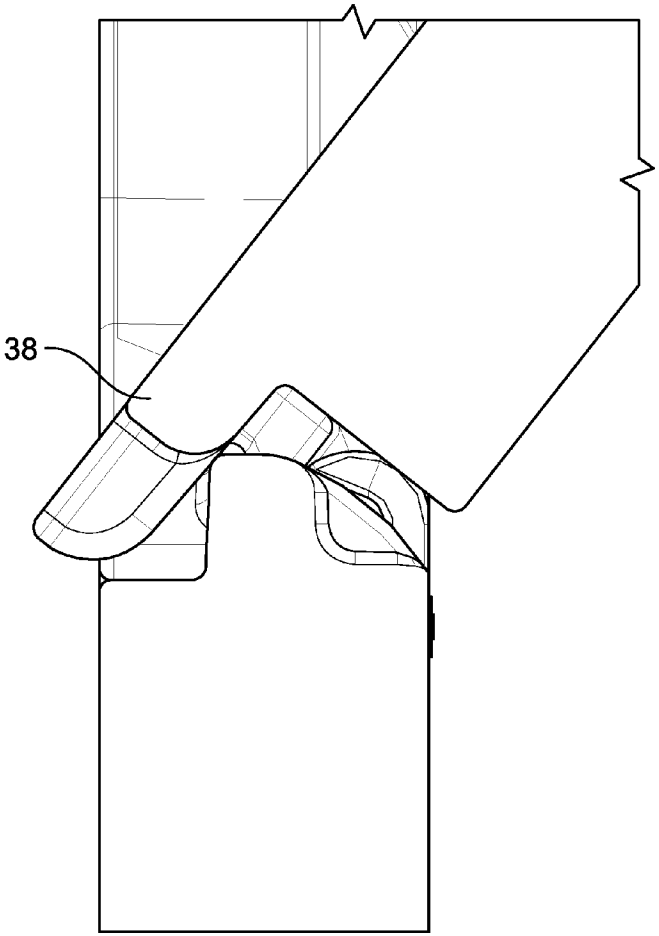
FIG. 5 is a cross-section of the drop door and side wall of FIG. 3 in a partially opened position.

The present invention is directed to an improvement for a bulk container having a drop door in a side wall. Specifically, the drop door is provided with a central extension that contacts the side wall along a bottom edge of the drop door. This allows loads applied to the upper edge of the drop door to be transferred to the side wall and inhibits buckling of the door or undue pressure on the hinge elements. An embodiment of the present invention having the central extension is illustrated in FIGS. 1, 2 and 6. The invention is an improvement over bulk containers without the extension as shown in FIGS. 3, 4 and 5.

Figure 8:
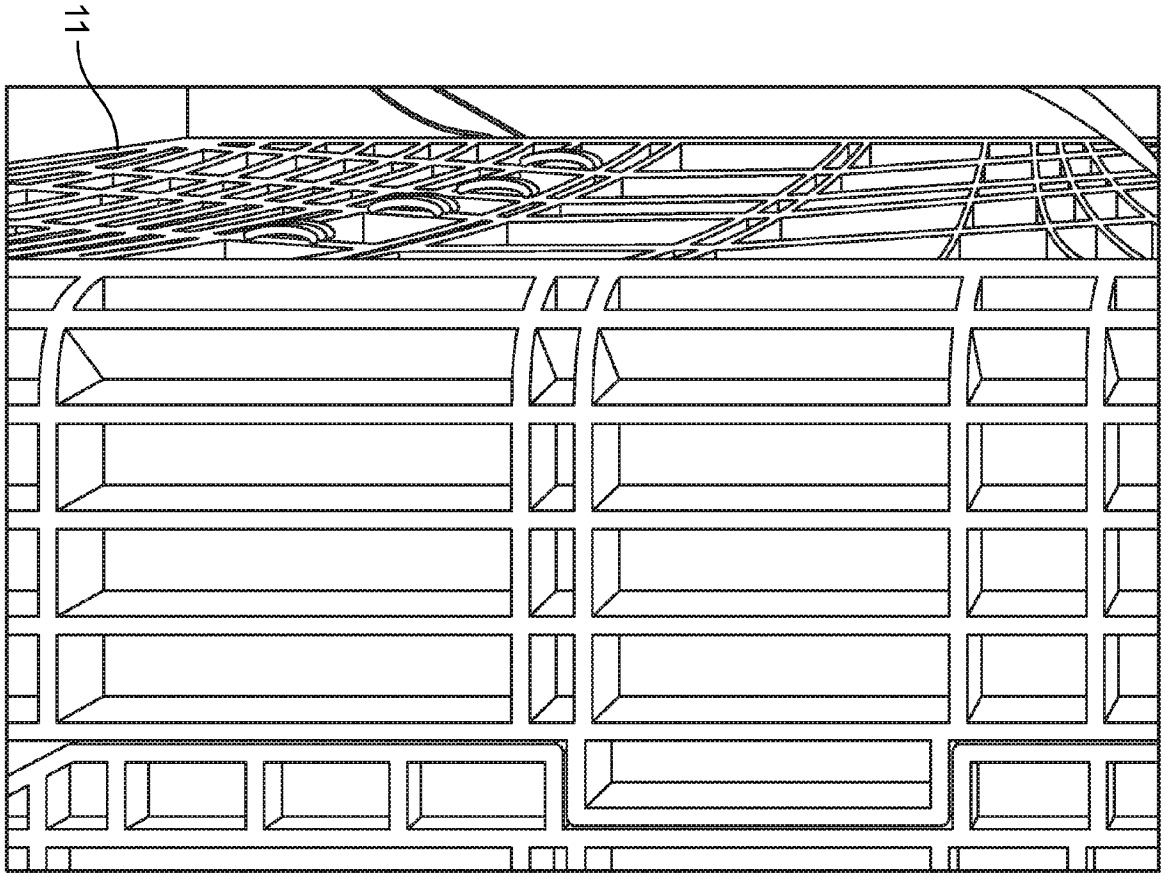
FIG. 8 is a partial perspective view of an embodiment of a bulk container of the present invention in an upright position.

Referring to FIGS. 1 and 8, respectively, a partial view of a side wall 12 and a base 11 of a bulk container in accordance with the present invention is shown. The side wall 12 includes a generally rectangular opening for a drop door 14. The bottom edge 16 of the drop door 14 is connected to the side wall 12 by a first articulated hinge 18 and a second articulated hinge 20 spaced from the first articulated hinge 18. Conventional latches (not shown) can be used at the top of the drop door 14 to secure the drop door 14 to the side wall 12 when in an upright position.

The first and second articulated hinges 18, 20 define or border a central portion therebetween. In prior bulk containers, this portion had a gap 22 between the bottom edge 16 of the drop door and an upper edge 24 of the side wall 12 forming a bottom of the opening for the drop door 14 as shown in FIGS. 3, 4 and 5. Loads applied to the top of the drop door 14 in this portion (e.g., by stacking of additional bulk bins or other material) were transferred primarily to the hinge components. The load caused displacement of the drop door 14 in this area (e.g., bowing or sagging) and undue stress on the hinge components.

The present bulk bin includes reinforcing structure to relieve the stress on the hinge components. Referring also to FIG. 2, the drop door 14 includes a lower, centrally located extension 26 positioned between the first articulated hinge 18 and the second articulated hinge 20. The extension 26 is sized to rest on the upper edge 24 of the side wall 12 that defines the lowermost portion of the opening for the drop door 14.

The extension 26 provides a central support structure that fills in the continuous gap 22 found between the hinge elements 18, 20 in prior bulk bins (again, as shown in FIGS. 3, 4 and 5). While the extension 26 is shown as a continuous single piece in FIG. 1, it can be two or more separate sections 40 with gaps 42 or without gaps 44 therebetween.

The extension 26 includes a first lower portion 30 that mates with a lower portion 32 along an exterior of the side wall 12 and an upper portion 34 that mates with a lip 36 on an interior side of the side wall 12 when in the upright position as shown in FIG. 2. It is apparent that any loads applied to the drop door 14 in this area are transmitted directly to the side wall 12.

Known bulk bin container drop door designs, such as that shown in cross-section in FIG. 4, allows a lower lip 38 of the drop door 14 to move inward. In contrast, the present design shown in FIG. 2 prevents the drop door 14 from moving inward. In this regard, the lip 36 abuts the side of the first lower portion 30 and locks the drop door 14 preventing it from moving inward.

FIGS. 5 and 6 show the known and the present designs, respectively, in a partially opened position. Unlike the known design, the central support structure of the present design helps stabilize the door as it rotates.

In an alternative embodiment, the extension can be an upward extension from the upper edge of the side wall 12. In a further alternative embodiment, one or more extensions (whether from the drop door or the side wall) can be formed on the right and/or left side of the central portion (i.e., between one of the first and second hinge elements and the edge of the door or opening).

Many modifications and variations of the present invention are possible in light of the above teachings. It is, therefore, to be understood within the scope of the appended claims the invention may be protected otherwise than as specifically described.

We claim:

1. A bulk container comprising:

a base;

a first side wall extending upward from a first side of the base, the first side wall including an opening;

a first drop door rotatably connected to the first side wall by a first articulated hinge and a second articulated hinge spaced from the first articulated hinge, the first drop door filling the opening and forming part of the first side wall when in an upright position and exposing the opening when in an open position; and a first central support structure connected to and extending downward from a lower edge of the first drop door between the first articulated hinge and the second articulated hinge and a second central support structure connected to and extending upward from a lower edge of the first side wall between the first articulated hinge and the second articulated hinge, wherein the first central support structure contacts the second central support structure when the first drop door is in the upright position such that loads applied to a top of the drop door are transferred to the first side wall through the first and second central support structures.

2. The bulk container of claim 1 wherein the first and second central support structures prevents the first drop door from moving inward.

3. The bulk container of claim 1 wherein the first central support structure comprises a rib.

4. The bulk container of claim 1 wherein the first side wall is hingedly connected to the base.

5. The bulk container of claim 1 further comprising a second side wall extending upward from a second side of the base, a third side wall extending upward from a third side of the base, and a fourth side wall extending upward from a fourth side of the base.

6. The bulk container of claim 5 further comprising:

a second drop door rotatably connected to the second side wall by a first articulated hinge and a second articulated hinge spaced from the first articulated hinge, the drop door filling the opening and forming part of the second side wall when in an upright position and exposing the opening when in an open position; and a central support structure extending downward from a lower edge of the second drop door between the first articulated hinge and the second articulated hinge, wherein the central support contacts an upper edge of the second side wall defining a lower limit of the opening such that loads applied to a top of the drop door are transferred to the second side wall through the central support structure of the second drop door.

7. The bulk container of claim 1 wherein the first central support structure comprises a first segment and a second segment separated from the first segment by a gap.

8. The bulk container of claim 1 wherein the first central support structure comprises a plurality of segments separated by gaps.

9. The bulk bin container of claim 1 wherein the side wall includes a lip extending from the interior side of the side wall.

10. A bulk container comprising:

a base;

a first side wall extending upward from a first side of the base, the first side wall including an opening;

a first drop door connected to the first side wall by a first articulated hinge and a second articulated hinge spaced from the first articulated hinge, the first drop door filling the opening and forming part of the first side wall when in an upright position and exposing the opening when in a collapsed position; and a central support structure extending one of upward from an upper lower edge of the first side wall between the first articulated hinge and the second articulated hinge and downward from a lower edge of the first drop door, wherein the central support structure contacts a lower edge of the first drop door when the first drop door is in the upright position such that loads applied to a top of the first drop door are transferred to the first side wall through the central support structure and wherein the central support structure comprises a first portion and a second portion separated from the first portion by a gap.

11. The bulk container of claim 10 wherein the central support structure prevents the drop door from moving inward.

12. The bulk container of claim 10 wherein the first portion of the central support structure comprises a rib.

13. The bulk container of claim 10 wherein the first side wall is hingedly connected to the base.

14. The bulk container of claim 10 further comprising a second side wall extending upward from a second side of the base, a third side wall extending upward from a third side of the base, and a fourth side wall extending upward from a fourth side of the base.

15. The bulk container of claim 14 further comprising:

a second drop door connected to the second side wall by a first articulated hinge and a second articulated hinge spaced from the first articulated hinge, the second drop door filling the opening and forming part of the second side wall when in an upright position and exposing the opening when in a collapsed position;

a central support structure extending upward from an upper lower edge of the second side wall between the first articulated hinge and the second articulated hinge, wherein the central support contacts a lower edge of the second drop door such that loads applied to a top of the second drop door are transferred to the second side wall through the central support structure.

16. The bulk container of claim 10 wherein the container is made of plastic.

17. The bulk container of claim 1 wherein the first central support structure does not contact the second support structure when the drop door is in the open position.

18. The bulk container of claim 10 wherein the central support structure does not contact an other of the upper lower edge of the first side wall between the first articulated hinge and the second articulated hinge and downward from a lower edge of the first drop door.

* * * * *

UNITED STATES PATENT AND TRADEMARK OFFICE

CERTIFICATE OF CORRECTION

PATENT NO. : 9,296,557 B2
APPLICATION NO. : 14/577612
DATED : March 29, 2016
INVENTOR(S) : Robert Petersen et al.

It is certified that error appears in the above-identified patent and that said Letters Patent is hereby corrected as shown below:

In the Claims

In Column 5, Line 29, in Claim 9, after "bulk" delete "bin".

Signed and Sealed this
Fourteenth Day of June, 2016

Michelle K. Lee

Michelle K. Lee
*Director of the United States Patent and Trademark Office*